US008136307B2

(12) United States Patent
Hofmeister

(10) Patent No.: US 8,136,307 B2
(45) Date of Patent: Mar. 20, 2012

(54) ROOF CONSTRUCTION

(76) Inventor: Eckard Hofmeister, Herford (DE)

( * ) Notice: Subject to any disclaimer, the term of this patent is extended or adjusted under 35 U.S.C. 154(b) by 206 days.

(21) Appl. No.: 12/413,906

(22) Filed: Mar. 30, 2009

(65) Prior Publication Data

US 2009/0249709 A1 Oct. 8, 2009

(30) Foreign Application Priority Data

Apr. 4, 2008 (DE) ..... 10 2008 017 335

(51) Int. Cl.
*E04B 1/32* (2006.01)

(52) U.S. Cl. ..... 52/80.1; 52/81.2; 52/86; 52/90.1; 52/245

(58) Field of Classification Search ..... 52/80.1, 52/81.2, 84, 86, 90.1, 202, 236.2, 245, 249, 52/406.1, 406.2, 406.3, 404.1
See application file for complete search history.

(56) References Cited

U.S. PATENT DOCUMENTS 4,408,423 A * 10/1983 Lautensleger et al. ..... 52/90.1
4,471,585 A * 9/1984 Peter ..... 52/18
5,195,291 A * 3/1993 Pomento ..... 52/644
5,815,989 A * 10/1998 Bennenk et al. ..... 52/80.1

FOREIGN PATENT DOCUMENTS

| | | |
|---|---|---|
| AT | 503021 B1 | 7/2007 |
| DE | 804958 | 5/1951 |
| DE | 238252 A1 | 8/1986 |
| DE | 3827333 A1 | 2/1989 |
| DE | 19823610 A1 | 12/1999 |

* cited by examiner

*Primary Examiner* — William Gilbert
*Assistant Examiner* — Patrick Maestri
(74) *Attorney, Agent, or Firm* — Richard M. Goldberg

(57) ABSTRACT

Roof construction having a roof skin mounted on a base construction and including a bottom skin and a top skin mounted above and spaced apart from the bottom skin, the roof skin having a two-dimensionally curved surface, the bottom skin being supported on the base construction via a grid that is formed by plane plates oriented normal to the plane of the grid and crossing one another, top edges of the plates being curved to define the curvature of the roof skin, the surface of the roof skin being divided into segments at least some of which are spanned by an associated set of straight lines, and the top skin is held at a constant spacing from the bottom skin by spacer profiles extending along the straight lines.

12 Claims, 1 Drawing Sheet

ROOF CONSTRUCTION

BACKGROUND OF THE INVENTION

The invention relates to a roof construction having a roof skin mounted on a Base construction and comprising a bottom skin and a top skin mounted above and spaced apart from the bottom skin.

In such a roof constuction, the double-shell constuction of the roof skin provides for the nessecary stability snd the tightness of the roof. Preferably, an insulating layer, especially a heat insulating layer, is provided in the space between the bottom skin and the top skin.

SUMMARY OF THE INVENTION

It is an object of the invention to provide a roof construction of this type which offers the possibility to achieve appealing architectural effects.

According to the invention, this object is achieved by the features that:

the roof skin has a two-dimensionally curved surface, the bottom skin is supported on the base construction via a grid that comprises plane plates that are oriented normal to the plane of the grid and cross each other, the top edges of the plates being curved and defining the curvature of the roof skin, the surface of the roof skin is divided into segments at least some of which are spanned by a set of straight lines, and the top skin is held at a constant distance from the bottom skin by spacer profiles that extend along these straight lines.

The two-dimensionally curved surface of the roof skin results in an elegantly swaying shape of the outer surface of the roof which is aesthetically very appealing.

By means of the grid, the roof skin is stably secured to the base construction, and by providing the plates that form the grid with a suitable contour of their top edges, the three-dimensional shape of the roof skin can be defined precisely.

The problem is to secure the top skin on the bottom skin in such a manner that, on the one hand, a sufficient stability is achieved which can withstand the wind and/snow loads that have to be expected and, on the other hand, the top skin will everywhere have the same distance from the bottom skin and will thus precisely follow the shape of the bottom skin as defined by the grid. According to the invention, this problem is solved by the features that the surface of the roof skin is divided into imaginary segments that are continuously adjoined to one another, preferably with smooth transitions, and at least some of which are spanned by an associated set of straight lines, in the manner as, for example, the generated surface of a cone is spanned by a set of generatrices or the two-dimensionally curved peripheral surface of a cooling tower is spanned by a set of skew straight lines that are inclined relative to the vertical. Such straight lines are also termed ruling lines. Then, within each of these segments, a stable mounting of the top skin can be achieved by spacer profiles that extend over the bottom skin along these ruling lines. In this way, the top skin will precisely reflect the shape of bottom skin.

Depending upon the shape of the roof, there may also exist segments that have a spherically curved surface. These segments can not be spanned by straight lines, but, for securing the top skin, it is possible here to use spacer profiles that are curved corresponding to the spherical curvature of a known cupola construction.

Useful optional features of the invention are indicated in the dependent claims.

The segments into which the surface of the roof skin is divided are preferably polygonal. The shape of the segments may follow the raster that is pre-established by the grid, but may also be independent from this grid. The running direction of the ruling lines may different from segment to segment and will be selected dependent on the shape of the roof, such that continuous transitions are obtained at the borders of the segment wherever possible.

The bottom skin and the top skin, respectively, may for example be formed by welded metal sheets. A particularly decorative effect is obtained when the top skin is formed by or covered with sheets of stainless steel.

BRIEF DESCRIPTION OF THE DRAWINGS

An embodiment example of the invention will now be explained in conjunction with the drawing, wherein.

DETAILED DESCRIPTION

Figure 1:
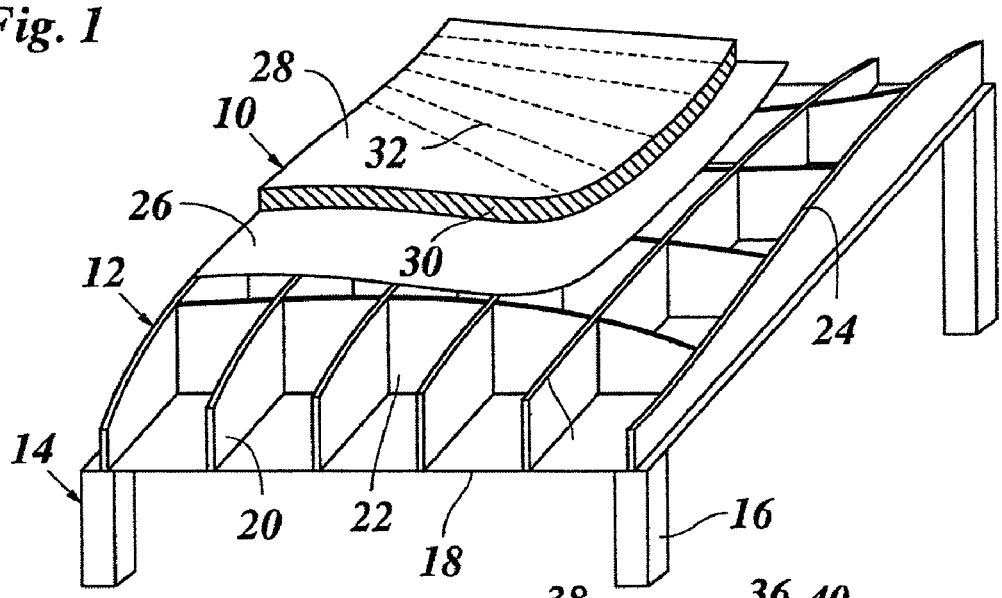
FIG. 1 is a schematic perspective view, partly in section, of a roof construction according to the invention.

The roof construction shown in FIG. 1 comprises a multi-layer roof skin 10 supported on a base construction 14 via a grid 12. The base construction 14 is formed by vertical supports 16 which define at first a plane roof surface 18 which at the same time forms the bottom side of the grid 12.

The grid 12 is formed by vertically oriented longitudinal and transverse plates 20, 22 that cross one another and the top edges 24 of which have respectively different curvatures. In this way, the two-dimensional curvature of the roof skin 10 is defined.

The roof skin 10 comprises a bottom skin 26 that may be formed, for example, by welded metal plates, and a top skin 28 that is also formed by metal plates, e. g. of stainless steel, that are welded or tightly joined to one another in any other way and are arranged to form a constant spacing with the bottom skin 26. An insulating layer 30 is provided in the space between the bottom skin 26 and the top skin 28.

The surface of the roof skin 10 may have a relatively complicated three-di-mensional relief as defined by the grid 12, but may be divided into a number of smaller or larger, e. g. polygonal segments within which the surface may at least approximately be developed into a plane or may at least be spanned by a set of straight lines 32, as has been indicated schematically in FIG. 1.

Figure 2:
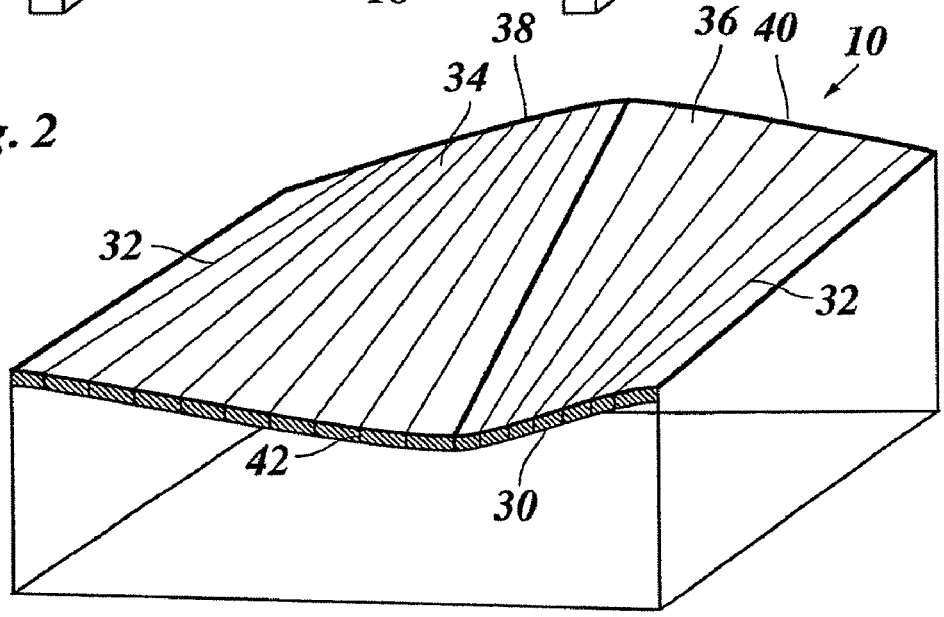
FIG. 2 is a sketch illustrating the division of the roof skin into polygonal segments.

By way of example, FIG. 2 shows a portion of the roof skin 10 that is divided into two segments 34, 36 that have in this case a quadrangular shape and each have a negative (saddle-like) curvature and are spanned by a set of straight lines 32. In the example shown, the straight lines 32 at the joint between the two segments 34 and 36 extend approximately in parallel with this joint, so that a continuos and smooth transition is obtained there. Additional segments that have not been shown may be adjoined to the segments 34, 36 in any direction. For example, the rear edges 38, 40 of the two segments shown in FIG. 2 might continuously adjoin to a segment that is formed by a part of the surface of a cone and can accordingly be spanned by straight generatrix lines of the cone.

At the front edge of the roof skin, FIG. 2 shows a cross-section of the insulation layer 30. Moreover, the cross-sectional shape of spacer profiles 42 has been indicated, which extend along the straight lines 32 and each of which stably connects the top skin 26 to the bottom skin 28 on the entire length of the profile.

Figure 3:
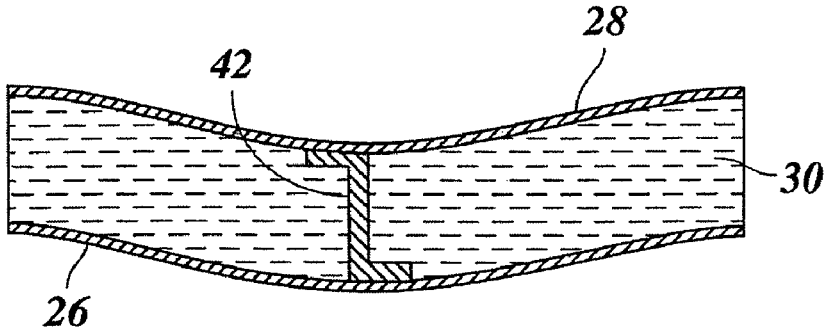
FIG. 3 is a schematic cross-sectional view of the roof skin.

The cross-section of such a spacer profile 42 has been shown on a larger scale in FIG. 3. In this example, the spacer profile 42 is a Z-shaped metal profile a lower flange of which is welded to the bottom skin 26 whereas a top flange is liquid-tightly connected to the top skin 28, e. g. by means of screws. Since each of the spacer profiles 42 extends along one of the straight lines 32 shown in FIG. 2, they can easily be manufactured and mounted. Thanks to the division of the roof skin into segments in which the straight lines 32 may have different orientations, it is nevertheless possible to achieve a high degree of design freedom in terms of the three-dimensional shape of the roof skin.

The invention claimed is:

1. Roof construction comprising:

a base construction, a roof skin mounted on the base construction and comprising a bottom skin and a top skin mounted above and spaced apart from the bottom skin, and the roof skin a two-dimensionally curved surface which is a surface curved in two mutually orthogonal directions and in which, for any given direction, there is a curvature along some portion of the curved surface, a grid which supports the bottom skin on the base construction, the grid extending in a plane and the grid formed by plane plates oriented normal to the plane of the grid and crossing one another, with top edges of the plates being curved to define a curvature of the roof skin, the surface of the roof skin being divided into segments, at least some of which are spanned by an associated set of straight lines in three dimensions, with at least some of said straight lines being disposed at at least one varying angle with respect to other ones of said straight lines, and spacer profiles which hold the top skin at a constant spacing from the bottom skin, the spacer profiles extending along the straight lines.

2. Roof construction according to claim 1, further comprising an insulating layer provided between the bottom skin and the top skin.

3. Roof construction according to claim 1, wherein the segments are polygonal.

4. Roof construction according to claim 1, wherein the spacer profiles have a Z-shaped cross-section.

5. Roof construction according to claim 1, wherein the straight lines are not included in a common plane.

6. Roof construction comprising:

a base construction, a grid formed by first plates extending in a first direction and second plates extending in a second direction which is at an angle to the first direction, with the first plates crossing the second plates at multiple locations, and with top edges of both the first and second plates being curved to define a curvature of the grid in said first and second directions, a roof skin mounted on the grid so as to follow the curvature of the grid in said first and second directions, the roof skin extending in a direction normal to the top edges of the plates and comprising a bottom skin, a top skin mounted above and spaced apart from the bottom skin and spacer profiles which hold the top skin at a constant spacing from the bottom skin, and the roof skin being divided into segments, at least some of which are spanned by an associated set of straight lines extending in three dimensions, with each straight line disposed at at least one varying angle with respect to both said first and second plates.

7. Roof construction according to claim 6, further comprising an insulating layer provided between the bottom skin and the top skin.

8. Roof construction according to claim 6, wherein the segments are polygonal.

9. Roof construction according to claim 6, wherein the spacer profiles have a Z-shaped cross-section.

10. Roof construction according to claim 6, wherein at least some of said straight lines are disposed at at least one varying angle with respect to other ones of said straight lines.

11. Roof construction according to claim 6, wherein, for any given direction, there is a curvature along some portion of the curved surface.

12. Roof construction according to claim 6, wherein said two-dimensionally curved surface is a surface curved in two mutually orthogonal directions.

* * * * *